US007159528B1

(12) United States Patent
Hilliker

(10) Patent No.: US 7,159,528 B1
(45) Date of Patent: Jan. 9, 2007

(54) SNORKEL APPARATUS AND METHODS OF USE

(76) Inventor: Wesley L. Hilliker, 38481 Evergreen La., Albany, OR (US) 97322

( * ) Notice: Subject to any disclaimer, the term of this patent is extended or adjusted under 35 U.S.C. 154(b) by 0 days.

(21) Appl. No.: 11/266,096

(22) Filed: Nov. 3, 2005

Related U.S. Application Data

(60) Provisional application No. 60/626,030, filed on Nov. 8, 2004.

(51) Int. Cl.
*B63C 11/46* (2006.01)

(52) U.S. Cl. ..... 114/315; 128/201.27

(58) Field of Classification Search ..... 114/315; 128/201.11, 201.27
See application file for complete search history.

(56) References Cited

U.S. PATENT DOCUMENTS

| | | | | |
|---|---|---|---|---|
| 2,593,988 | A | 4/1952 | Cousteau | |
| 4,674,493 | A | 6/1987 | Mitchell | 128/202.14 |
| 4,832,013 | A * | 5/1989 | Hartdorn | 128/202.14 |
| 5,193,530 | A | 3/1993 | Gamow et al. | 128/201.27 |
| 5,327,849 | A | 7/1994 | Miller | 114/315 |
| 5,351,681 | A * | 10/1994 | Hudson | 128/201.11 |
| 5,606,967 | A * | 3/1997 | Wang | 128/201.11 |
| 5,924,416 | A | 7/1999 | Miller | 128/201.27 |
| 5,947,116 | A * | 9/1999 | Gamow et al. | 128/201.11 |
| 2004/0003811 | A1 | 1/2004 | Bodnar | |

OTHER PUBLICATIONS

Product Literature on FUBA by Water Toys, Inc.

* cited by examiner

*Primary Examiner*—Stephen Avila
(74) *Attorney, Agent, or Firm*—Lori M. Friedman

(57) ABSTRACT

Disclosed is an apparatus and methods for a plurality of users to work and/or play underwater with a supply of breathable air. The breathable air is taken from the atmosphere above the surface of the water. The air is sent to one or two submerged users. The apparatus and its components are enclosed in a water resistant enclosure encapsulated by an inner tube which floats on the surface of the water. The apparatus provides breathable air to one or two users from a flexible air supply line, which runs from the apparatus to each submerged user. The air pumps of the apparatus push a constant flow of breathable air to each user. Each user inhales air from the apparatus with a mouth piece that is connected to the air supply line which is connected to the air pumps. Equipment such as regulators, tanks or reservoirs are not needed. The apparatus is powered by a dry cell battery and does not require fuel to operate.

20 Claims, 3 Drawing Sheets

SNORKEL APPARATUS AND METHODS OF USE

RELATED PATENT APPLICATIONS

This is a utility patent application based on a U.S. Provisional patent application Ser. No. 60/626,030 filed Nov. 8, 2004 which is hereby incorporated by reference.

BACKGROUND OF THE INVENTION

1. Field of the Invention

This invention relates to a floatable underwater breathing apparatus. More specifically, it relates to an apparatus and methods for a plurality of users to work and/or play underwater with a supply of breathable air. The unit is designed for use by recreational scuba underwater users, under water salvagers, and boat repairers.

2. Background and Related Art

There have been many inventions relating to providing breathable air to underwater swimmers, divers, and others who either desire underwater recreation or need to work underwater. In the past, use of plain snorkels, involving one end floating on the water and supplying air to user at the other end have been limited. This is because of the limitations regarding the depth and distance requirements that the user must heed.

The limitations of the simple snorkel device led to the development of more sophisticated apparatuses. One early method of underwater breathing involved having a pump located on a boat on the water's surface. Air was then fed through a hose and into a pressurized suit worn by a diver. This allowed for periods of extended diving but necessitated a boat, a crew, and a pump. The diver was required a wear special gear and did not enjoy free movement.

Later attempts at providing underwater breathing to users was SCUBA (self-contained underwater breathing apparatus) developed by Jacques Cousteau and described in U.S. Pat. No. 2,593,988 in 1952. In this art, a pressurized tank is worn on the diver's back. The air pressure is regulated according to the demand and depth and breathing air is supplied to the diver. Among the drawbacks of the Cousteau technique is that it requires the user to wear a pressurized tank on his back. Significant cost and training is also needed to use this technique.

Later practices include a number of products that float independently on the surface of a body of water. Typically, such a device consists of an air compressor powered by a gasoline engine mounted on a floatation device. These techniques have led to other, similar devices that use electric or solar-powered, rather than gasoline, motors. Drawbacks of these devices include their weight, expense, and inherent danger in case of power failures. Other, more recent underwater breathing devices, such as that of Gamow et al in U.S. Pat. No. 5,193,530 uses pumpable reservoirs of air wherein the user/diver must wear a breathing means having a flow-restrictor shut-off valve, a one-way inlet valve, a one-way exhaust valve. Miller, in U.S. Pat. No. 5,327,849, and in later U.S. Pat. No. 5,924,416 uses a compressor in his apparatus. In contrast applicant uses a diaphragm air pump to supply air in his invention.

Another big difference between these inventions is that Miller uses a pressure switch so that the pumps of his invention pumps do not constantly operate, but turn off and on as demand requires. Applicant's invention continuously pumps free-flowing air and is not turned on and off during use.

Further distinctions and differences between applicant's invention and the prior art will be made clear as further detailed description and diagrams are viewed and understood by the reader.

SUMMARY OF THE INVENTION

This invention relates to an apparatus that supplies a continuous flow of fresh, breathable air to at least one underwater user. The continuous air flow relieves the user of constantly watching an air tank or reservoir capacity. The apparatus of this invention supplies a continuous flow of air that does not need to be regulated and does not require certifications concerning the use of regulators, compressed air tanks or reservoirs. The user's continuous air supply relieves the need to use an air regulator or any special equipment. There are no breathing constraints as there are in breathing compressed air from tanks and reservoirs.

A great number of hazards involved with underwater activities result from regulators and compressed air tanks and reservoirs. The instant invention requires no regulators or compressed air tanks or reservoirs, or engines requiring fuel to operate. An additional advantage provided by the present invention is the safe and simultaneous supply and abundance of fresh air for more than one user.

Specific examples of the use of the device and methods of this invention will be soon described in the Detailed Description of Preferred Embodiments.

DETAILED DESCRIPTION OF PREFEFERD EMBODIMENTS

Figure 1:
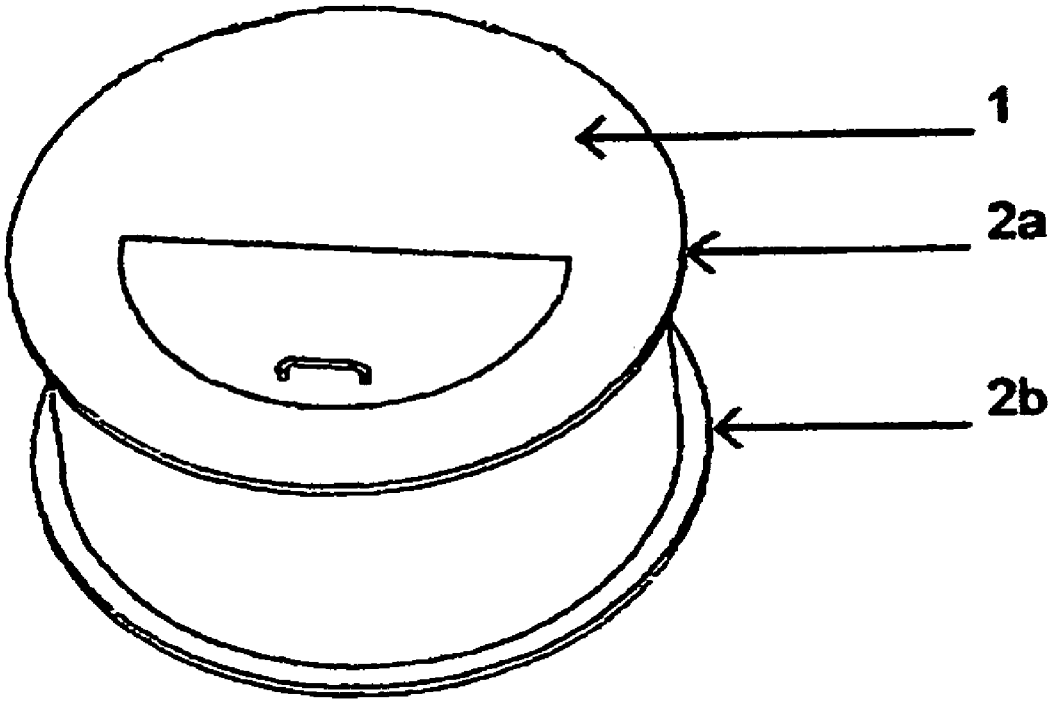
FIG. 1 shows the container compartment. of the invention

As can be seen in FIG. 1, the underwater breathing apparatus of this invention has a water-resistant enclosure 1 that can be floated on the surface of a body of water. The water-resistant enclosure 1 can be made of polyethylene, polypropylene, Lucite, polyvinyl chloride, or other weldable thermoplastic polymers. Parts of the water-resistant enclosure 1 are shown in FIG. 1, including the lips 2*a* and 2*b* that encircle the top and bottom of the water-resistant enclosure 1. The top lip 2*a* is about 29 inches in diameter. The bottom lip, 2*b* is about 19 inches in diameter. This difference in diameter size between the top and bottom lips allows the circular rubber inner tube 9 (in its deflated state) to be mounted around the water-resistant enclosure 1.

Figure 2:
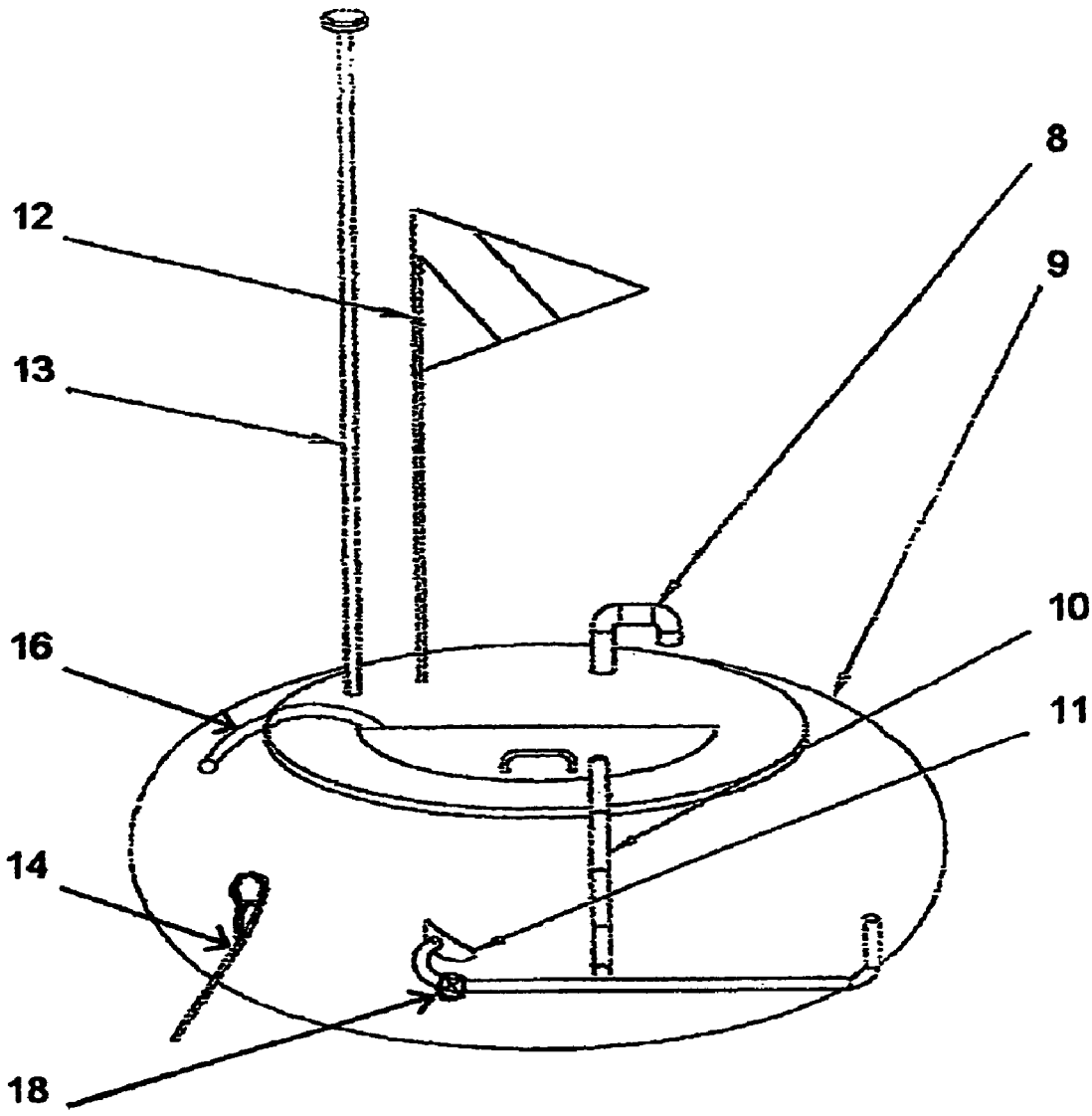
FIG. 2 shows the exterior components and the inner tube that keeps the component container afloat.

Shown in FIG. 2 is the circular rubber inner tube 9 in its inflated state. The circular rubber inner tube 9 is inflated with air by a short tube air inflation line 16 that is supplied with the invention. The inflation line 16 secures the circular rubber inner tube 9 in place around the water-resistant enclosure 1 by the expansion of air. The floating air-inflated circular rubber inner-tube 9 is inflated with air to allow the water-resistant enclosure 1 to float on the surface of the water. As seen in FIG. 2, the air supply line 10 runs from the water-resistant enclosure 1 to the one or more users (not shown) mouthpieces 11. The air supply line 10 allows the users to breathe fresh air while submerged underwater.

The mouthpiece 11 is connected to the water-resistant enclosure 1 via the air supply line 10. The mouthpiece 11 allows the users to draw fresh breathing air from the water-resistant enclosure 1 via the air supply line 10. Any unused portion of fresh air (exhaust air) is vented away from the user via a check valve 18 in the mouthpiece 11.

The fresh air vent tube 8 prevents water entry into the water-resistant enclosure 1. The tether line 14 is attached to the circular rubber inner tube 9. The tether line 14 is made of a strong material that is suitable to allow the floating apparatus to be pulled by the user. It also serves as a life line between the user and the water-resistant enclosure 1. The materials can be polypropylene, cotton, nylon, and similar materials.

FIG. 2 also shows that outside of the water-resistant enclosure 1 there are several safety features present in the snorkel apparatus of this invention. They include a flag 12 that is placed on top of the water-resistant enclosure 1. The flag 12 is a warning signal to other water crafts and those on the surface of the water that a person is submerged in the vicinity of the flag 12. Another safety feature of this invention is a safety surface light 13. The light 13 is for both night safety and for warning boats and sea crafts of the location of the water-resistant enclosure 1 and its users.

Figure 3:
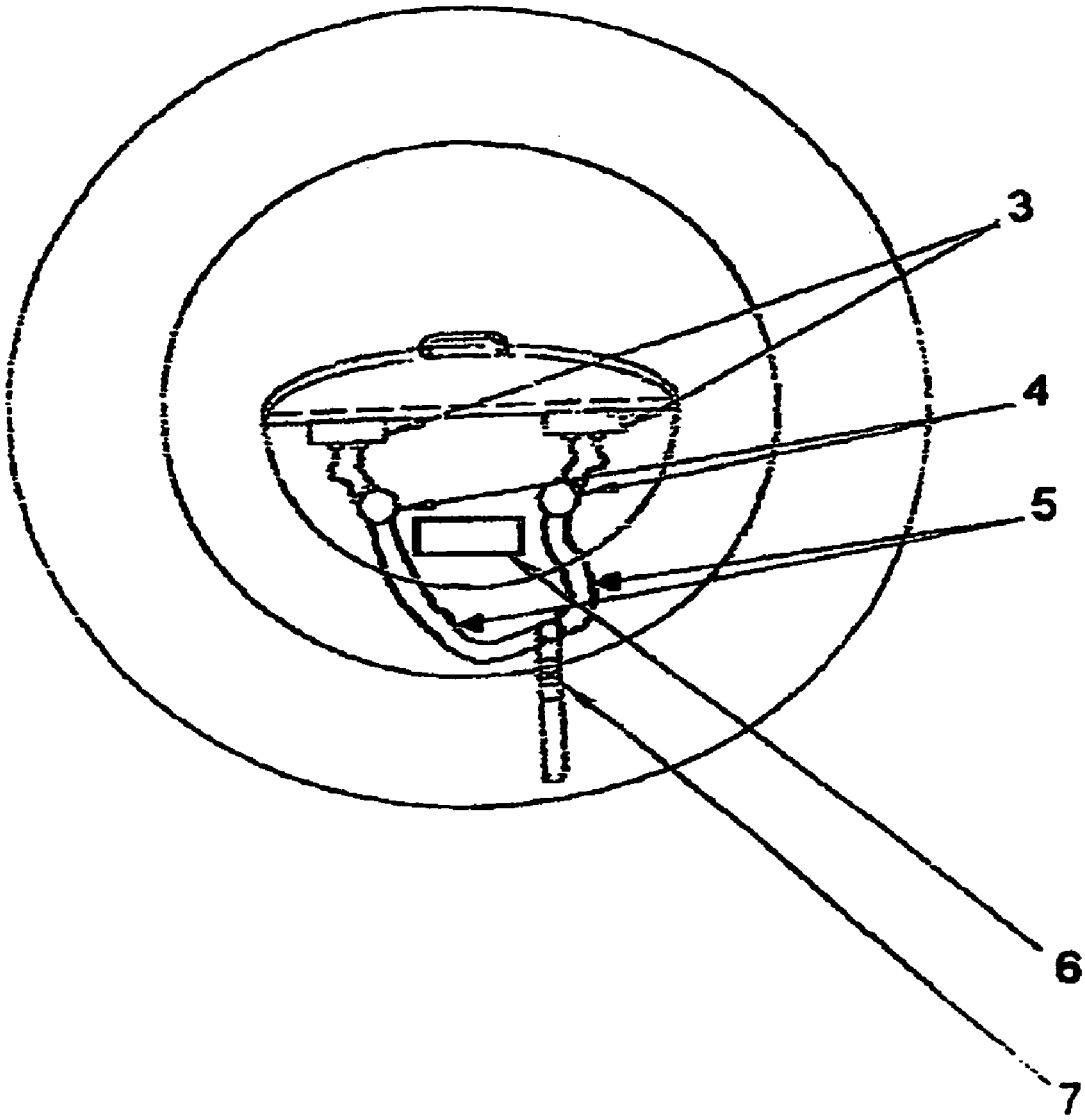
FIG. 3 shows the interior of the container compartment looking downward from above.

Seen in FIG. 3 is the water-resistant enclosure 1 that contains a plurality of air pumps 3 that are each connected to a flexible air supply line 5 that is in turn connected to a combination quick disconnect/check valve 4 that connects to an air collection header 7 that generates a constant flow of breathable air to at least one user through a mouthpiece 11. The air pumps used are oil-less diaphragm pumps such as those manufactured by the Gast Manufacturing Company. A complete description of this product can be found at www-.gastmfg.com. There is a dry cell battery 6 that is connected to the air pumps 3 that enable a supply of breathable air to reach at least one user for an extended period of time; The time period is from about 50 to about 80 minutes for two users and 100 to 160 minutes for one user depending on what size of dry cell battery 6, is used. A specific dry cell battery that can be used in this invention is an Odyssey 925 dry cell battery or an Odyssey 1200 dry cell battery. These are made by the Odyssey Battery Company. A complete description of these products can be found at www.odysseybatteries.com.

An air collection header 7 allows at least one user to breathe fresh air while underwater. Additional air supply lines 10 can be added to the air collection header 7 which is in the water-resistant enclosure 1 of this invention.

Methods of Use

The apparatus of this invention can be used by one or two people who are working and/or enjoying a pleasurable water experience. The breathable air received by a user is untreated surface air and does not require the use of accessories selected from the group consisting of compressed air, air storage tanks, and reservoirs. In this invention, users are persons requiring a reliable and constant supply of breathable air while underwater. Such people are typically recreational scuba underwater users, under water salvagers, and boat repairers.

Another use for the water-resistant enclosure 1 on this invention is that the circular inflatable tube 9 can be disconnected from the water-resistant enclosure 1 and hooked to a boat for use as a ski tube. This use is for recreational users; a user who is snorkeling can remove the circular inflatable tube 9 from the water-resistant enclosure 1 and hook it behind a boat for use as a ski tube.

The water-resistant enclosure 1 of this invention supplies breathable air to at least one underwater user without the use of cumbersome underwater breathing gear. This is accomplished by the user by the steps of a) providing a water-resistant enclosure 1 with a plurality of air pumps 3 that are each connected to a flexible air supply line 5 which is in turn connected to a combination quick disconnect and check valve 4 that connects to a air collection header 7 that generates a constant flow of breathable air to the underwater user and an energy source comprising a dry cell battery 6 that is connected to the air pumps 3 that enable a supply of breathable air to reach an underwater user for an extended period of time;

b) connecting a plurality of air supply lines 10 each with two ends, that supply said breathable air to at least one mouthpiece 11 that is connected to the air collection header 7 at one end and to an underwater user's mouthpiece 11 and the other end;

c) turning on the pump 3 prior to placing mouthpiece 11 in a user's mouth to insure that air supply lines are free of water;

d) placing a user's mouth on the mouthpiece 11 to breathe air while performing a desired underwater task.

The method of supplying breathable air to two underwater users can be for time periods ranging from about 50 to about 80 minutes. If there is only one user, the time period increases to about 100 to about 160 minutes.

The breathable air received by at least one user is untreated surface air and does not require the use of accessories such as compressed air, air storage tanks, or reservoirs.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. An underwater breathing apparatus comprising a) a water-resistant enclosure contained inside a circular inflatable tube that floats on the surface of a body of water;

b) a plurality of air pumps that are each connected to a flexible air supply line which is connected to a combination quick disconnect and check valve that is connected to an air collection header that generates a constant flow of breathable air to at least one user;

c) a plurality of air supply lines that supply said breathable air to at least one user;

d) at least one mouthpiece that is connected to said air supply line and to the user's mouth;

e) a dry cell battery that is connected to said air pumps that enable a supply of breathable air to reach at least one user for an extended period of time;

f) a top and bottom lip that encircle both the top and bottom of the water-resistant enclosure that enables the circular inflatable tube in its deflated state to first be mounted around the water-resistant enclosure and then to be inflated and operate as an air transporter and as a floatation device;

g) a safety flag mounted outside of the water-resistant enclosure that indicates the presence of at least one user in the area to other people in the area;

h) a safety warning light mounted on top of the water resistant enclosure that can be is turned on by a switch by the user when the device is used in darkness;

i) an air collection header mounted inside the water resistant enclosure that is connected to an internal check valve that connects the air pumps to the air-supply lines that transport air to at least one user;

j) two fresh air vent tubes that supply air to the air pumps and prevent water entry into the water-resistant enclosure k) an air-inflated circular tube that, when inflated with air, encapsulates the water-resistant enclosure and keeps it afloat;

l) a circular rubber inner tube that is inflated with air by a short air inflation line;

m) a tether line made of a strong material that allows the water-resistant enclosure to be pulled by the user that are combined into a floating underwater breathing apparatus that enables at least one user to breathe through a mouthpiece while underwater.

2. The underwater breathing apparatus of claim 1 wherein the water-resistant enclosure is made from materials selected from the group consisting of polyethylene, polypropylene, Lucite, polyvinyl chloride, and other weldable thermoplastic polymers.

3. The underwater breathing apparatus of claim 1 wherein use by two users are for time periods ranging from about 50 to about 80 minutes and use for one user is for time periods ranging from about 100 to 160 minutes.

4. The underwater breathing apparatus of claim 1 wherein the breathable air received by the user is untreated surface air and does not require the use of accessories selected from the group consisting of compressed air, air storage tanks, and reservoirs.

5. The underwater breathing apparatus of claim 1 wherein breathable air can be supplied to two users simultaneously.

6. The underwater breathing apparatus of claim 1 wherein the user is a person requiring a reliable and constant supply of breathable air while underwater.

7. The underwater breathing apparatus of claim 6 wherein the user is selected from the group consisting of recreational scuba underwater users, underwater salvagers, and boat repairers.

8. The underwater breathing apparatus of claim 1 wherein the circular inflatable tube is disconnected from the underwater breathing apparatus and hooked to a boat for use as a ski tube.

9. A method of supplying breathable air to at least one underwater user, said method comprising the steps of a) outfitting a water-resistant enclosure b) equipping the enclosure with a plurality of air pumps that are each connected to a flexible air supply line member which is connected to a combination quick release and check valve that is connected to an air collection header that generates a constant flow of breathable air to at least one underwater user through at least one mouthpiece that is connected to a user's mouth and to a plurality of air supply lines, a dry cell battery that is connected to said air pumps that enable a supply of breathable air to reach at least one underwater user for an extended period of time, lips that encircle both the top and bottom of the water-resistant enclosure that enable the circular inflatable tube in its deflated state to first be mounted around the water-resistant enclosure and then to be inflated and operable as an air transporter and as a floatation device, an air collection header connected to a quick release and check valve that connects said pumps to the air supply lines that go to the user and prevents backflow, a fresh air vent tube that prevents water entry into the water-resistant enclosure and provides intake air for the air pumps, a tether line made of a material that is suitable to allow the water-resistant enclosure to be pulled by the user, an air-inflated circular tube that, when inflated with air, encapsulates the water-resistant enclosure and keeps it afloat resulting in underwater breathing ability of the underwater user through a mouthpiece.

10. The method of supplying breathable air to at least one underwater user of claim 9 wherein use by two users can be for time periods ranging from about 50 to about 80 minutes and ranging from about 100 to about 160 minutes for one user.

11. The method of supplying breathable air to at least one underwater user of claim 9 wherein the breathable air received by the user is untreated surface air and does not require the use of accessories selected from the group consisting of compressed air, air storage tanks, and reservoirs.

12. The method of supplying breathable air to at least one underwater user of claim 9 wherein breathable air can be supplied to two users simultaneously.

13. The method of supplying breathable air to at least one underwater user of claim 9 wherein the user is a person requiring a reliable and constant supply of breathable air while underwater.

14. The method of supplying breathable air to at least one underwater user claim 13 wherein the user is selected from the group consisting of recreational scuba underwater divers, underwater salvagers, and boat repairers.

15. A method of supplying breathable air to at least one underwater user without the use of cumbersome underwater breathing gear accomplished by the user by the steps of a) providing a water-resistant enclosure with a plurality of air pumps that are each connected to a flexible air supply line which connects to a combination quick release and check valve that connects to a air collection header that generates a constant flow of breathable air to the underwater user and an energy source comprising a dry cell battery that is connected to said air pumps that enable a supply of breathable air to reach the underwater user for an extended period of time;

b) connecting a plurality of air supply lines, each with two ends, that supply said breathable air to at least one mouthpiece that is connected to said air collection header at one end and to an underwater user's mouthpiece at the other end;

c) turning on the pump prior to placing mouthpiece in a user's mouth to insure that supply lines are free of water;

d) placing the user's mouth on the mouthpiece to breathe air while performing a desired underwater task.

16. The method of supplying breathable air to at least one underwater user of claim 15 wherein use by two users can be for time periods ranging from about 50 to about 80 minutes and from about 100 to about 160 minutes for one user.

17. The method of supplying breathable air to at least one underwater user of claim 15 wherein the breathable air received by the user is untreated surface air and does not require the use of accessories selected from the group consisting of compressed air, air storage tanks, and reservoirs.

18. The method of supplying breathable air to at least one underwater user of claim 15 wherein breathable air can be supplied to two users simultaneously.

19. The method of supplying breathable air to at least one underwater user of claim 15 wherein the user is a person requiring a reliable and constant supply of breathable air while underwater.

20. The method of supplying breathable air to at least one underwater user of claim 19 wherein the user is selected from the group consisting of recreational scuba underwater divers, underwater salvagers, and boat repairers.

* * * * *